United States Patent [19]

Corsette

[11] Patent Number: 4,596,344

[45] Date of Patent: Jun. 24, 1986

[54] MANUALLY ACTUATED DISPENSER

[76] Inventor: Douglas F. Corsette, 6559 Firebrand St., Los Angeles, Calif. 90045

[21] Appl. No.: 539,965

[22] Filed: Oct. 7, 1983

[51] Int. Cl.[4] ..... B67D 5/42

[52] U.S. Cl. ..... 222/340; 222/380; 222/383; 239/333

[58] Field of Search ..... 222/340, 380, 383, 321; 239/331, 333, 329

[56] References Cited

U.S. PATENT DOCUMENTS

| | | | |
|---|---|---|---|
| 3,840,157 | 10/1974 | Hellenkamp | 222/309 |
| 4,046,292 | 9/1977 | Corsette | 222/383 |
| 4,050,613 | 11/1977 | Corsette | 222/321 |
| 4,079,865 | 3/1978 | Kutik | 222/259 |
| 4,109,832 | 8/1978 | Kutik et al. | 222/318 |
| 4,111,367 | 9/1978 | Hayes | 230/333 |
| 4,154,374 | 5/1979 | Kirk, Jr. | 222/318 |
| 4,161,288 | 7/1979 | McKinney | 239/333 |
| 4,345,718 | 8/1982 | Horvath | 239/333 |

*Primary Examiner*—Joseph J. Rolla
*Assistant Examiner*—Louise S. Heim
*Attorney, Agent, or Firm*—Watson, Cole, Grindle & Watson

[57] ABSTRACT

A dispenser of the pressure accumulated type includes a unitary pump plunger actuated for reciprocation within a variable volume pump chamber defined by an accumulator which is displaced upon an accumulation of pressure for opening the discharge as a discharge valve thereon becomes unseated, the compression stroke of the plunger acting in a direction opposite displacement of the accumulator in a direction opening the discharge.

20 Claims, 4 Drawing Figures

17
11
22
26
21
28
18
23
34
27
19
14
13
33
25
32
12
56
41
24
15
16
38
37
58
39

35
31
55
57
50
10
53
46
49
48
44
45
51
52
43
47
42
36

10
21
22
26
32
29
11
28
23
13
14
25
27
35
24
15
50
12
58
42
57
31
48

49
43
51
52
36
42

49
12
48

51
59
47

49
12

48
51
61
47

MANUALLY ACTUATED DISPENSER

BACKGROUND OF THE INVENTION

This invention relates generally to a dispenser of the pressure accumulating type in which a discharge is opened upon an accumulation of pump pressure above a predetermined minimum. Dispensers of this type are often used as sprayers for products requiring a predetermined pressurized discharge.

Dispensers of the general class described herein are well known in the prior art, as shown for example in my prior U.S. Pat. Nos. 4,046,292 and 4,050,613, and various prior art patents cited therein.

SUMMARY OF THE INVENTION

It is an object of the present invention to provide an alternative approach to the prior dispensing pumps as mentioned above, while at the same time retaining a reduced and simplified number of parts and the assembly thereof for a dispenser of a type capable of achieving a substantially dripless product discharge.

The manually actuated dispenser according to the invention comprises a pump body capable of being affixed in fluid tight communication with the opening of the container of flowable product to be dispensed. The pump body contains an accumulator element in the form of a hollow sleeve having an annular discharge valve thereon and an annular packing gland for guiding and sealing the accumulator during its displacement between discharge closing and opening positions. A hollow plunger containing a check valve controlled inlet passage has a piston portion extending into the open sleeve and therewith defines a variable volume pressure pump chamber during plunger reciprocation which may be manually carried out by a trigger actuator hingedly mounted on the pump body. A blind socket is formed at one end of the pump body, and the accumulator therewith defines an enclosed variable volume pressure accumulation chamber of larger diameter than and in direct and open communication with the pump chamber. A return coil spring acting between the plunger and the accumulator normally resiliently urges the discharge valve into a sealed discharge closing position in which it is seated in fluid tight manner on an annular sealing ring or seat provided at the blind socket end to prevent leakage through a discharge passage extending outwardly of the accumulation chamber. The spring likewise resiliently urges the plunger into a container vent closed and sealed position. The piston end of the plunger is contoured to match a confronting surface on the pump body reducing the clearance volume to a minimum and achieving a high compression ratio for purging unwanted air from the pump chamber and through the discharge before and during priming upon intermittent actuation of the trigger which effects reciprocation of the plunger. The pressure in the accumulation chamber increases during the compression stroke of the plunger such as to create a force acting on the accumulator in opposition to and in excess of the resilient thrust of the return spring. The accumulator thus shifts away from the blind socket end of the pump body whereupon its discharge valve becomes unseated to open the discharge passage to thus permit the contents of the pump chamber to be discharged under pressure. The discharge will continue until the pressure in the pump chamber is again overcome by the resilient force of the spring thereby closing the discharge as the accumulator returns to its original position in which its discharge valve is reseated to close the product flow. At the end of the plunger suction stroke, as finger pressure on the trigger is released, a container vent valve located on the plunger closes the container vent. Such a vent may be defined by an axial groove located in an annular collar on the pump body which functions as a vent valve seat. Otherwise, container venting may be effected by the provision of an axial groove or a through opening in a skirt on the plunger depending from the vent valve.

Other objects, advantages and novel features of the invention will become more apparent from the following detailed description of the invention when taken in conjunction with the accompanying drawings.

DETAILED DESCRIPTION OF THE INVENTION

Figure 1:
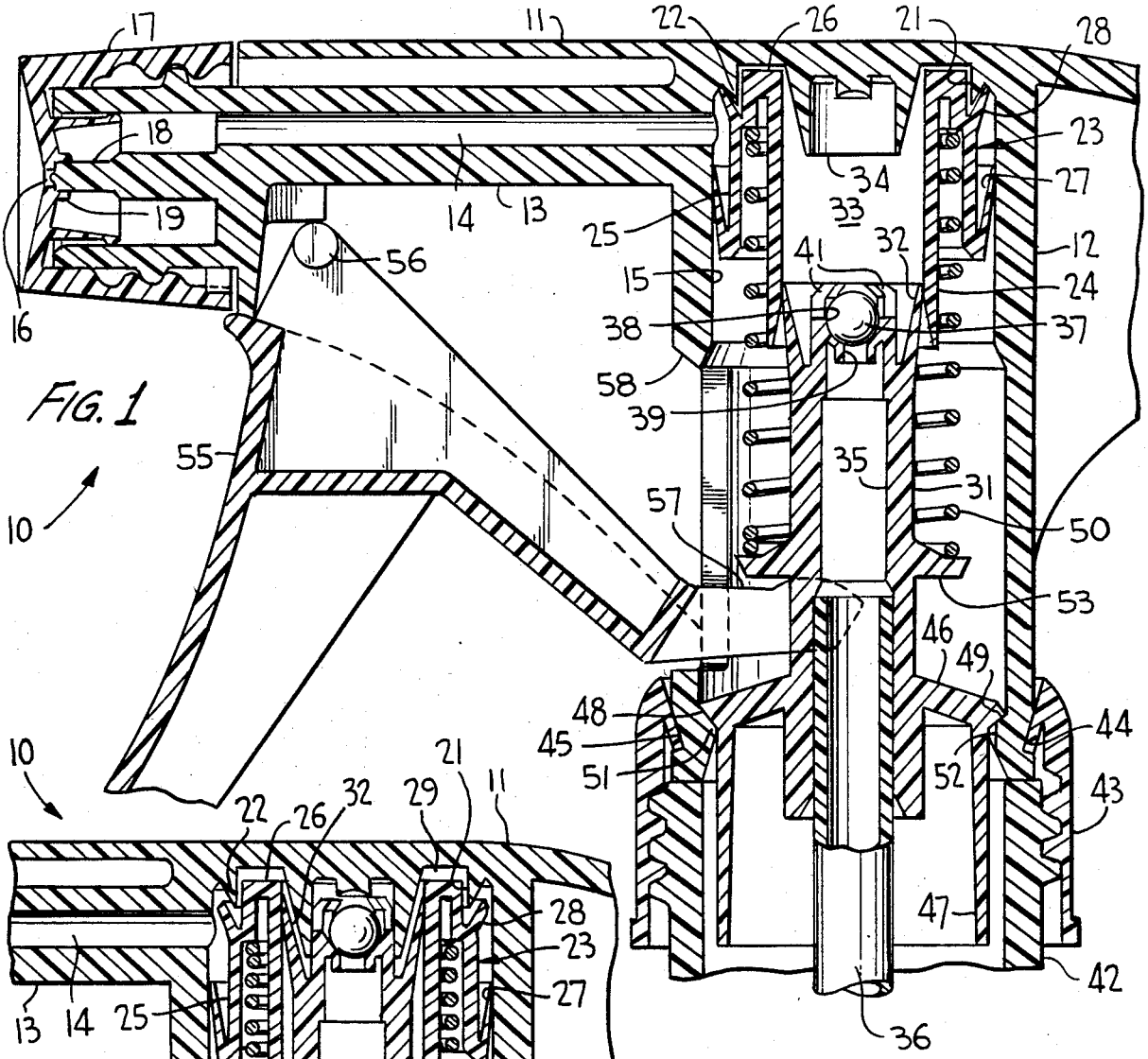
FIG. 1 is a vertical sectional view of a dispenser according to the invention, shown mounted on the neck of a container of flowable product to be dispensed, the pump elements of the dispenser being shown in their at rest position prior to trigger actuation.

Turning now to the drawings wherein like reference characters refer to like and corresponding parts throughout the several views, a manually actuated dispenser according to the invention, generally designated 10, comprises a pump body 11 having a cylindrical portion 12, and a discharge barrel 13 containing a longitudinal discharge passage 14 which opens at one end into an interior annular wall 15 in the form of a cylindrical bore of portion 12. The terminal end of the discharge passage communicates with a discharge orifice 16 provided in a discharge nozzle 17 shown threaded onto the terminal end of barrel 13 in a discharge closing position. A pin 18 at the terminal end of barrel 13 is seated within a cup 19 surrounding the discharge orifice in the discharge closing position of FIG. 1. The discharge may be opened in a known manner by unthreading the discharge nozzle, and cup 19 may include a swirl chamber for misting.

Portion 12 of the pump body is formed at one end to provide a downwardly directed blind socket 21 delimited by an annular sealing rib 22. An accumulator element 23, disposed in body portion 12 for sliding displacement along wall 15, includes an open-ended sleeve 24 defining a pump cylinder and surrounded by a concentric skirt 25 joined by an annular shoulder 26. A packing gland 27 on skirt 25 bears against inner wall 15 of body portion 12 for guiding the accumulator therealong in a fluid tight manner. An annular discharge valve 28 is provided near the upper end of skirt 25, and is seated against sealing rib 22 in the discharge closing position of FIG. 1. The accumulator as aforedescribed defines with the blind socket a variable volume pressure accumulation chamber 29 in the form of a cylindrical bore, delimited by rib 22, coaxial with the bore formed by wall 15.

A hollow plunger 31 is mounted for reciprocation within body portion 12, and has a piston portion 32 at its upper end extending into sleeve 24 of the accumulator so as to therewith define a variable volume pressure pump chamber 33 which is in open and direct communication with accumulation chamber 29. And, the piston end of the plunger and the shoulder end of the accumulator are contoured to substantially match the shape of confronting surfaces on the pump body including extension 34 on the pump body. As will be described in more detail hereinafter, these matching surfaces permit unwanted air to be substantially purged from the pump chamber through the discharge passage before and during priming to thereby improve upon pump operating efficiency.

The plunger contains an inlet passage 35 which communicates at its lower end, via a connected dip tube 36, with the interior of the container (not shown) of flowable product to be dispensed. The flow of the product through the inlet passage is controlled by a check valve which may be in the form of a ball check 37 normally seated against an inlet valve seat 38 surrounding a valve opening 39 at the upper end of the inlet passage. A cage in the form of upstanding fingers 41 surrounds the ball check and limits the movement thereof in a known manner when unseated. Of course, the check valve could be in the form of an integral, self hinged valve similar to that disclosed in my earlier U.S. Pat. No. 4,050,613, without departing from the invention.

The pump body is adapted to be secured in fluid tight communication with the opening of the container of flowable product to be dispensed. For this purpose a container closure cap 43 which may be internally threaded or otherwise arranged for securing it in a liquid tight manner engages neck 42 of the container which is similarly threaded, and has an annular inwardly directed flange 44 at its upper end in engagement with a mating groove 45 provided around the periphery of body portion 12 for fixing the dispenser body onto the container neck.

An annular shoulder 46 on the plunger has an annular skirt 47 depending therefrom, and an annular vent valve 48 extending radially outwardly of the skirt. In the at rest position of FIG. 1, this valve bears against a vent seat 49 defined by the upper side of an annular and inwardly extending rim 51. A container vent extending between opposite sides of this rim may be in the form of a groove 52 which permits equalization of pressures within and outside the container, and which permits return to the container of any flowable product which may leak or seep past the plunger, as to be more fully described hereinafter.

A coil return spring 50 extends between the accumulator and an abutment on the plunger which may also serve as a plunger lift flange 53 on the plunger for resiliently urging the accumulator into a discharge closed and sealed position and the plunger into a vent valve closed and sealed position, as shown in FIG. 1. And, a trigger actuator 55 is provided for manually actuating the plunger, the trigger being hingedly mounted on the pump body as at 56, and having a forked end 57 extending through an opening 58 in the pump body for engagement with the underside of lift flange 53.

Figure 3:
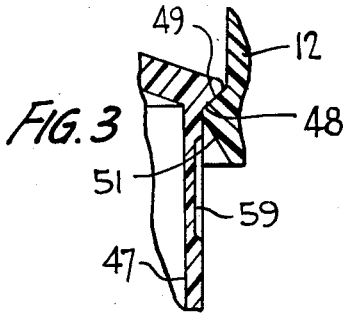
FIGS. 3 and 4 are views similar to FIG. 1 of a portion of the dispenser showing alternative container vent valving arrangements.
Figure 4:
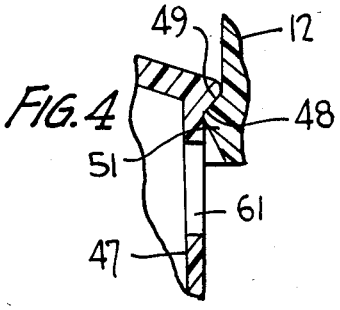

Alternative container vent valving arrangements are shown in FIGS. 3 and 4. Here, groove 52 in rim 51 is omitted, and an axial groove 59 is provided in skirt 47 (FIG. 3), or a through opening 61 is provided in skirt 47 (FIG. 4). Thus, after the vent valve is unseated upon commencement of the plunger compression stroke, rim 51 becomes juxtaposed to groove 59 (FIG. 3) or to opening 61 (FIG. 4) to vent the container to atmosphere via opening 58.

MODE OF OPERATION

Figure 2:
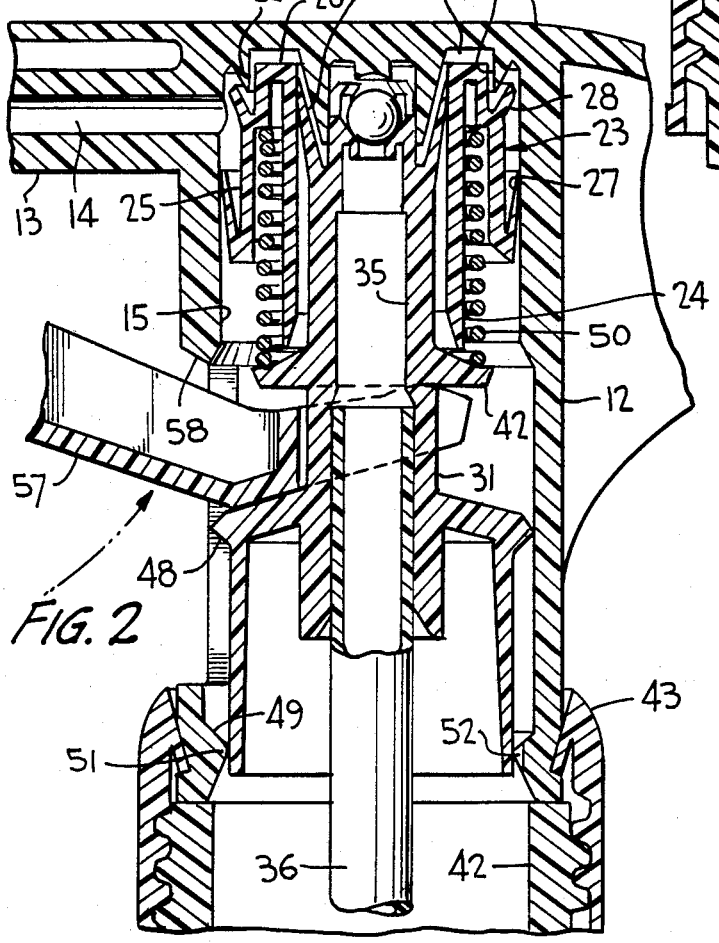
FIG. 2 is a view similar to FIG. 1, in which the plunger is shown at or near the end of its compression stroke with the inlet valve closed and the discharge valve open.

With the parts of the dispenser in the at rest position of FIG. 1, any air in the pump and accumulation chambers may be substantially purged from the dispenser by pulling back on the trigger, in the direction of the arrow of FIG. 2, to thereby compress the plunger so that the compressed air in the pump chamber acts on the larger diameter accumulation chamber to shift the accumulator toward the FIG. 2 position. Discharge valve 28 thereof is thus slightly moved away from sealing rib 22 sufficiently to bleed off some of the compressed air through passage 14 by establishing communication between chamber 29 and passage 14. Repeated reciprocation ingests some fluid and expels some air until fully primed. The plunger may at all times be compressed until the contour of extension 34 makes contact or near contact with the matching contour at the upper end of the plunger. Since the upper end of the accumulator matches the facing contour of the bore, the accumulation chamber volume is at a minimum, resulting in a high compression ratio between plunger swept volume and the net clearance volume with the plunger fully compressed. During priming, accumulated air is thus effectively squeezed out of the chambers before commencement of the normal dispensing operation.

The accumulator is guided along wall 15 of body portion 12 by packing gland 27 which opens toward the accumulation chamber to avoid the passage of fluid around the accumulator. And, lift flange 53 may act as a limit stop for the plunger as it bears against the accumulator at the end of the plunger compression stroke so as to avoid movement of piston portion 32 beyond the upper end of the accumulator. Any leakage of the product from the accumulation chamber around the piston portion is thus avoided.

In accordance with usual practice, subsequent reciprocation or reciprocations of the pump plunger, upon actuation of the trigger, functions to prime the pump by expelling air from the chambers as aforedescribed and by suctioning flowable product upwardly through dip tube 36 and inlet passage 35 and into the pump chamber due to the reduced pressure in the pump chamber relative to the atmospheric pressure in the container acting on the product contained therein.

At the commencement of the pumping or priming operation, the various parts of the present dispenser are as shown at rest in FIG. 1 with spring 50 resiliently urging the accumulator into a discharge closed and sealed position in which product flow is interrupted from the accumulation chamber as discharge valve 28 is seated in a fluid tight manner against sealing rib 22. And, in this position, the coil spring resiliently urges the plunger into a container vent closed and sealed position as vent valve 48 bears in a fluid tight manner against its vent seat 49. Any leakage of product from the pump chamber through the discharge and from the container through vent 52, is therefore substantially avoided.

During the initial compression stroke of the plunger, effected upon pulling back on the trigger in the direction of the arrow in FIG. 2, spring 50 is compressed and, as the compression stroke continues, the pressure within the pump and accumulation chambers will progressively increase and will create a downward hydraulic force on the upper end of the accumulator within the larger diameter accumulation chamber. When this downward force is sufficient to overcome the counterbalancing force of the spring, the accumulator will be displaced downwardly to its open position of FIG. 2, in which communication is established between the accumulation chamber and the discharge passage, whereby product from the pump chamber will be discharged under pressure through discharge passage 14 with discharge valve 28 moved away from sealing rib 22. Discharge from the pump chamber will continue so long as the pressure of product within the accumulation chamber is sufficient to maintain the accumulator displaced downwardly so as to maintain the discharge passage uncovered. Thus, sustained discharge may be effected by the selection of a predetermined spring tension and the provision of a sufficiently large diameter for the accumulation chamber relative to that of the pump chamber so that, upon drawing back quickly on the trigger, the quick accumulation of fluid under pressure acting in chamber 29 will be more slowly counterbalanced by the spring, as it maintains the regulated pressure against the discharge nozzle until chamber 29 is purged, or until the trigger is released.

The spring pressure will reseat the accumulator within the socket at the upper end of body portion 12 so as to again close off the discharge by outlet valve 28, as the pressure within the accumulation chamber becomes insufficient to maintain the discharge passage open, either because of insufficient pressure on the plunger by the trigger actuator or through discharge of the contents of the chambers near the end of the compression stroke. Upon release of the trigger at any point in the compression stroke, the return spring will quickly shift the accumulator to close the discharge valve and shift the plunger outwardly of the pump chamber to thereby increase its volume and accordingly decrease its pressure so as to suction a new charge of product into the pump chamber.

During the plunger reciprocation, skirt 47 functions as a plunger guide as it bears against the inner edge of rim 51. This skirt likewise functions as a spill guard preventing product from leaking through container vent 52 while operating the dispenser with its nozzle slanting steeply downwardly. The container vent is disposed on a side of the pump body opposite the side from which the discharge nozzle extends, so that product will essentially be trapped within the spill guard while dispensing downwardly.

On the other hand, if product escapes through the container vent while dispensing upwardly, the cavity around the skirt within the container neck defines a sump area through which product is suctioned back into the container during the compression stroke of the plunger, as the upwardly moving skirt 47 causes an expansion of the space above the liquid in the container. Moreover, skirt 47, together with shoulder 46, acts as a telescoping cork which functions in the manner of a piston during the plunger suction stroke to aid in forcing product up the dip tube as well as to suck liquid from the sump area into the container through the vent during the compression stroke.

From the foregoing it can be seen that a trigger operated dispenser has been devised with a minimum number of operating parts for easy operation and production, without leakage, and capable of economical production and assembly. The discharge barrel remains stationary while the plunger reciprocates within an accumulator defining a pump chamber which is displaced to open the discharge upon accumulation of pressure sufficient to counteract the force of a return spring. When not in use, both the discharge and the container vent are automatically sealed closed by the spring. The pump chamber is capable of being substantially purged of unwanted air during priming, such air being expelled through the discharge passage. A telescoping skirt depending from the plunger acts not only as a plunger guide but as a spill guard and also forms a sump area for controlling leakage and seepage of product through the container vent aided by the piston type action against the interior of the container.

Obviously, many modifications and variations of the present invention are made possible in light of the above teachings. It is therefore to be understood that within the scope of the appended claims the invention may be practiced otherwise than as specifically described.

What is claimed is:

1. A dispenser of a constant pressure accumualting type, comprising:

a pump body having an inwardly directed blind socket;

means on said pump body for securing same in fluid tight communication with the opening of a container of flowable product to be dispensed;

an accumulator slideably disposed in a cylindrical bore provided in said body, said accumulator defining a variable volume pressure accumulation chamber with said blind socket;

said accumulation chamber having a central cylindrical bore coaxaial with said cylindrical bore in said body;

a plunger disposed for reciprocation within said accumulator and having a piston portion, a portion of said pump body of said blind socket confronting said piston portion, and said piston portion defining with said accumulator and said body portion a variable volume pump chamber in communication with said accumulation chamber;

a discharge passage extending outwardly from said accumulation chamber and terminating in a discharge orifice;

means on said pump body for modulating the nature and rate of discharge of product through said orifice;

said accumulator having means thereon cooperating with said pump body for establishing and interrupting fluid flow from said accumulation chamber to said passage by relative movement between said accumulator and said piston in a direction opposite the direction of said plunger reciprocation;

said plunger having a check valve controlled inlet passage therethrough for establishing communciation between said pump chamber and the container of flowable product to be dispensed;

resilient means extending between and mututally biasing said accumulator and said plunger apart in opposite directions in an at rest position in which said accumulator lies in a product flow interrupting position and said plunger is displaced fully outwardly of said accumulator, during plunger reciprocation said accumulator maintaining a constant pressure discharge as regulated by the force of said resilient means independent of the degree of modulation and in response to the displacement rate and direction of reciprocation of said plunger; and means for reciprocating said piston independently of the movement of said accumulator.

2. The dispenser according to claim 1, wherein said resilient means comprise a coil spring encircling said accumulator and said plunger.

3. The dispenser according to claim 1, wherein seal means are provided on said pump body with which said accumulator means cooperates.

4. The dispenser according to claim 1, wherein said pump body is formed with an annular valve seat, said discharge passage extending away from said seat and said accumulator means being conformed for sealing engagement with said valve seat.

5. The dispenser according to claim 1, wherein said pump body has an inwardly extending rim having a surface defining a vent valve seat for at least one vent passage extending between opposite sides of said rim, and means on said plunger defining a vent valve engaging said seat for closing said vent pasage in said product flow interrupting position of said accumulator.

6. The dispenser according to claim 5, wherein said vent passage is located in said rim, said means on said plunger comprising a skirt in sliding engagement with said rim for guiding said plunger during reciprocation, said vent valve being annular and extending outwardly of said skirt.

7. The dispenser according to claim 5, wherein said means on said plunger comprises a skirt and an annular outward extension thereon defining said vent valve, said skirt being in sliding engagement with said rim for guiding said plunger during reciprocation, and said vent passage being defined by an axial outer groove located in said skirt.

8. The dispenser according to claim 5, wherein said means on said plunger comprises a skirt and an annular outward extension thereon defining said vent valve, said skirt being in sliding engagement with said rim for guiding said plunger during reciprocation, and said vent passage being defined by a through opening located in said skirt.

9. The dispenser according to claim 1, wherein said reciprocating means comprises a trigger actuator pivotally mounted on said body and in engagement with said plunger.

10. The dispenser according to claim 1, wherein said piston portion is contoured to match a confronting extension provided on said pump body, whereby any air in said chambers may be substantially purged through said discharge passage when opened upon displacement of said accumulator.

11. The dispenser according to claim 10, wherein said accumulator has a shoulder confronting a portion of said pump body, said shoulder being contoured to match said body portion for further purging any air in said chambers through said discharge passage when opened upon displacement of said accumulator.

12. The dispenser according to claim 5, wherein said discharge and vent passages are respectively located on opposite sides of said pump body.

13. The dispenser according to claim 5, wherein said means on said plunger comprises a shoulder having an outer skirt for defining a telescoping cork for aiding in forcing product into said inlet passage during said reciprocation.

14. The dispenser according to claim 1, wherein at least one vent passage is provided between said plunger and said pump body, said plunger having a vent valve thereon for closing said vent passage in said product flow interrupting position of said accumualtor, said resilient means further normally urging said vent valve into a vent closing position.

15. The dispenser according to claim 1, wherein said plunger has means thereon engaging said pump body during said reciprocation, said plunger means comprising a shoulder have an outer skirt for defining a telescoping cork for aiding in forcing product into said inlet passage during said reciprocation.

16. The dispenser according to claim 1, wherein at least one vent passage is provided between said plunger and said pump body at one side of said pump body, said plunger engaging said pump body for closing said vent passage in said product flow interrupting position of said accumulator, said discharge passage extending from a side of said pump body opposite said one side.

17. The dispenser according to claim 1, wherein at least one vent passage is provided between said plunger and said pump body, said plunger engaging said pump body for closing said vent passage in said product flow interrupting position, and means on said plunger defining a sump area at said vent passage through which any leaking product is suctioned into the container during reciprocation of said plunger.

18. The dispenser according to claim 17, wherein said piston portion extends from said piston in and one direction, and said means on said plunger comprises a skirt extending from said piston in an opposite direction.

19. The dispenser according to claim 1, wherein said plunger has a limit stop thereon for bearing engagement with an end of said accumulator for limiting movement of said piston portion beyond an opposite end of said accumulator during said reciprocation.

20. The dispenser according to claim 19, wherein said limit stop comprises a flange supporting one end of said resilient means and providing a bearing surface for said reciprocating means.

* * * * *